US006789487B2

(12) United States Patent
Torii et al.

(10) Patent No.: US 6,789,487 B2
(45) Date of Patent: Sep. 14, 2004

(54) FLUIDIZED BED INCINERATOR AND COMBUSTION METHOD IN WHICH GENERATION OF NOX, CO AND DIOXINE ARE SUPPRESSED

(75) Inventors: Isao Torii, Nagasaki-ken (JP); Kenji Tagashira, Nagasaki-ken (JP); Kazuyuki Myouyou, Nagasaki-ken (JP); Tatsuo Yokoshiki, Tokyo (JP); Takehiko Shirahata, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/001,973

(22) Filed: Dec. 5, 2001

(65) Prior Publication Data

US 2002/0066396 A1 Jun. 6, 2002

(30) Foreign Application Priority Data

Dec. 6, 2000 (JP) ..... 2000-371400

(51) Int. Cl.[7] ..... F23J 15/00; F23B 5/00

(52) U.S. Cl. ..... 110/345; 110/208; 110/210; 110/243

(58) Field of Search ..... 110/208, 210, 110/243, 244, 245, 342, 345, 346

(56) References Cited

U.S. PATENT DOCUMENTS 4,548,138 A * 10/1985 Korenberg ..... 110/245
4,867,079 A * 9/1989 Shang et al. ..... 110/264
4,962,711 A * 10/1990 Yamauchi et al. ..... 110/347
5,078,100 A * 1/1992 Huschauer et al. ..... 122/4 D
5,277,151 A * 1/1994 Paulhamus ..... 122/4 D
5,454,908 A * 10/1995 Olausson ..... 162/31
6,085,674 A * 7/2000 Ashworth ..... 110/347
6,230,664 B1 * 5/2001 Janka et al. ..... 122/4 D

FOREIGN PATENT DOCUMENTS

| | | |
|---|---|---|
| EP | 0 541 194 | 5/1993 |
| EP | 1 013 994 | 6/2000 |
| JP | 63-029104 | 2/1988 |
| JP | 01-181005 | 7/1989 |
| JP | 04-278114 | 10/1992 |
| JP | 6-123417 | 5/1994 |
| JP | 7-180822 | 7/1995 |
| JP | 2637449 | 4/1997 |
| JP | 9-210331 | 8/1997 |
| JP | 11-082968 | 3/1999 |
| WO | WO 90/04741 | 5/1990 |
| WO | WO 90/09549 | 8/1990 |

* cited by examiner

*Primary Examiner*—Kenneth Rinehart
(74) *Attorney, Agent, or Firm*—Oblon, Spivak, McClelland, Maier & Neustadt, P.C.

(57) ABSTRACT

A fluidized bed incinerator having a combustion furnace includes first to fourth combustion sections. Fuel is supplied to the first combustion section and an combustion exhaust gas is exhausted after the fourth combustion section. First to fourth airs are supplied to the first to fourth combustion sections in first to fourth air surplus rates, respectively. The second air surplus rate is equal to or more than the first air surplus rate, the third air surplus rate is equal to or more than the second air surplus rate, and the fourth air surplus rate is equal to or more than the third air surplus rate.

23 Claims, 6 Drawing Sheets

FLUIDIZED BED INCINERATOR AND COMBUSTION METHOD IN WHICH GENERATION OF NOX, CO AND DIOXINE ARE SUPPRESSED

BACKGROUND OF THE INVENTION

1. Field of the Invention

The present invention relates to a fluidized bed incinerator, and more particularly, to a fluidized bed incinerator and a combustion method in which generation of $NO_x$, CO and dioxine can be suppressed at the same time.

2. Description of the Related Art

Exhaust gas such as $NO_x$, CO, and dioxine are generally prescribed as regulation object materials about environmental quality. These materials can be decreased by providing a post processing apparatus to an incinerator. However, it is desirable from the viewpoint of the cost reduction in the manufacture, operation and maintenance of the incinerator to suppress the generation of these materials in the incinerator.

As one of the suppressing techniques of the $NO_x$ generation in combustion, a conventional technique is known in which air for the combustion is supplied to 2 steps. In the first step, an air surplus rate of supplied air is set to in a range of 0.8 to 0.9. In the second step, air is supplied to supplement a lack of air, resulting in complete combustion in the whole system. In this technique, the increase of flame temperature and the appearance of a local high temperature region are prevented by restraining rapid combustion reaction, and the generation of $NO_x$ is suppressed through the decrease of an oxygen quantity. In this technique, however, it is easy for incomplete combustion and unstable combustion to be caused, and they must be careful of the generation of non-combusted components such as CO. Therefore, this technique needs to be used together with another exhaust gas processing technique.

FIG. 1 is a diagram showing the structure of another conventional fluidized bed incinerator disclosed in Japanese Patent No. 2,637,449. The conventional fluidized bed incinerator will be described with reference to FIG. 1. The fluidized bed incinerator is composed of a combustion furnace 113, a cyclone 117, and a hopper 118. The combustion furnace 113 is composed of a first air supply port 101, a second air supply port 102, a furnace output port 105, a fuel input port 110, a heat transferring section 111, and a convectional heat transferring section 112.

In the bottom of the combustion furnace 113, fluidized material such as sand and fuel such as coal and sludge supplied from the fuel input port 110 are mixed and fluidized by air supplied from the first air supply port provided at the bottom to form a bed section 106 as a fluidized bed. Thus, combustion is carried out in the bed section 106. The temperature of the bed section 106 is controlled by flowing water or steam to the heat transfer pipe 111 provided in the bed section 106. Also, the convectional heat transferring section 112 is provided in the free board B108 as a combustion region above the bed section 106 to collect thermal energy of the exhaust gas by flowing water or steam in the convectional heat transferring section 112. For purposes of suppression of the generation of $NO_x$ and CO, the second air is supplied from the second air supply port 102. Generally, the bed section 106 is operated in the condition that an air rate of the first air quantity to a theoretical air quantity is 1.0 for the suppression of the generation of CO. The reason is as follows. That is, the temperature of a free board section A 107 is as low as 500 to 700° C. because the combustion in the fluidized bed is carried out at the temperature of 800 to 900° C. and the second air supply port 102 is provided above the bed section 106. When the fuel is combusted in the air rate of 1.0 or below in the bed section 106, a lot of CO is generated. The complete combustion cannot be carried out even if the second air is supplied. As a result, a part of CO is exhausted from the furnace output port 105. Therefore, in the actual operation, the air rate of the first air quantity to theoretical air quantity in the bed section 106 can be reduced only to about 1.0. For this reason, the bed section 106 is not set to deoxidation atmosphere, so that the generation quantity of $NO_x$ increases (150–250 ppm ($O_2$ 6% conversion)).

It should be noted that the cyclone 117 collects non-combusted ash in the exhaust gas. The hopper 118 stores the non-combusted ash. The stored the non-combusted ash is supplied to the bottom of the combustion furnace 113 as the fuel.

As described above, with the generation of the exhaust gas at the time of the combustion, it is not easy to achieve both of the suppression of generation of $NO_x$ and the suppression of generation of CO and dioxine kind at the same time. For the suppression of generation of $NO_x$, it is necessary to realize a deoxidation atmosphere by decreasing an air surplus rate of a quantity of air supplied actually in the combustion to a quantity of air to be supplied for the complete combustion of fuel (theoretical air quantity). On the other hand, for the suppression of generation of CO and dioxine, it is necessary to realize an oxidation atmosphere by increasing the air surplus rate. That is, it is difficult to simultaneously suppress the generation of $NO_x$, and the generation of CO and dioxine kind because of difference air surplus rates.

SUMMARY OF THE INVENTION

Therefore, an object of the present invention is to provide a fluidized bed incinerator and a combustion method in which the generation of $NO_x$, CO, and dioxine can be suppressed at the same time.

In an aspect of the present invention, a fluidized bed incinerator having a combustion furnace includes first to fourth combustion sections. Fuel is supplied to the first combustion section and a combustion exhaust gas is exhausted after the fourth combustion section. First to fourth airs are supplied to the first to fourth combustion sections in first to fourth air surplus rates, respectively. The second air surplus rate is equal to or more than the first air surplus rate, the third air surplus rate is equal to or more than the second air surplus rate, and the fourth air surplus rate is equal to or more than the third air surplus rate.

Here, it is desirable that the first combustion section combusts the fuel in a first temperature range in deoxidation atmosphere by the first air, to suppress generation of $NO_x$ and dioxine. It is desirable that the second combustion section combusts a non-combusted component of the fuel in a second temperature range in the deoxidation atmosphere by the second air, to suppress the generation of $NO_x$ and dioxine and to dissolve $NO_x$ and dioxine generated in the first combustion section. It is desirable that the third combustion section combusts a non-combusted component of the fuel in a third temperature range by the third air, to suppress the generation of $NO_x$ and dioxine and to dissolve $NO_x$ and dioxine generated in the second combustion section, and a fourth combustion section carries out complete combustion of a non-combusted component of the fuel in a fourth temperature range in oxidization atmosphere by the fourth air, to suppress the generation of $NO_x$ and dioxine and to dissolve $NO_x$ and dioxine generated in the third combustion section. In this case, the first to third temperature ranges may be substantially the same, and may be a range of 800° C. to 900° C.

Also, the fourth temperature range may be equal to or lower than each of the first to third temperature range, and may be a range of 750° C. to 850° C.

Also, the first temperature range of the first combustion section may be controlled by a first temperature control section, and the fourth temperature range of the fourth combustion section may be controlled by a second temperature control section. On the other hand, the second and third temperature ranges of the second and third combustion sections may be controlled by changing the second and third air surplus rates, respectively.

Also, it is desirable that the first air surplus rate is in a range of 0.5 to 0.7, the second air surplus rate is in a range of 0.7 to 0.9, the third air surplus rate is in a range of 0.9 to 1.15, and the fourth air surplus rate is in a range of 1.15 to 1.6.

Also, a residence time of a combustion gas in the first combustion section is desirably in a range of 1.5 to 2.5 seconds, and a residence time of a combustion gas in the second combustion section is desirably in a range of 0.5 to 1.5 seconds. Also, a residence time of a combustion gas in the first combustion section is desirably in a range of 0.1 to 1.0 second, and a residence time of a combustion gas in the first combustion section is desirably in a range of 1.5 to 2.5 seconds.

Also, the first combustion section may be a fluidized bed combustion section, and have a first air supply port provided in a bottom of the first combustion section.

Also, the second combustion section may have a second air supply port is provided in a range of 1500 to 2100 mm from the bottom, the third combustion section may have a third air supply port provided in a range of 3100 3700 mm from the bottom, and the fourth combustion section may have a fourth air supply port provided in a range of 4100 to 4700 mm from the bottom. In this case, the fluidized bed incinerator may further include a fuel supply port provided between the second air supply port and the third air supply port.

In another aspect of the present invention, a combustion method in a fluidized bed incinerator is achieved by (a) supplying fuel to a fist combustion section as a fluidized bet; by (b) combusting the fuel in a first temperature range by first air supplied to the first combustion section, while suppressing generation of $NO_x$ and dioxine; by (c) combusting a non-combusted component of the fuel in a second temperature range by second air supplied to a second combustion section, while suppressing the generation of $NO_x$ and dioxine and dissolving $NO_x$ and dioxine generated in the first combustion section; by (d) combusting a non-combusted component of the fuel in a third temperature range by third air supplied to a third combustion section, while suppressing the generation of $NO_x$ and dioxine and dissolving $NO_x$ and dioxine generated in the second combustion section; and by (e) carrying out complete combustion of a non-combusted component of the fuel in a fourth temperature range by fourth air supplied to a fourth combustion section, while suppressing the generation of $NO_x$ and dioxine and dissolving $NO_x$ and dioxine generated in the third combustion section.

In this case, the (b) and (c) steps may be carried out in a deoxidation atmosphere, and the (e) step may be carried out in an oxidation atmosphere.

Also, the first to fourth airs are supplied to the first to fourth combustion sections in first to fourth air surplus rates, respectively. At this time, it is desirable that the second air surplus rate is equal to or more than the first air surplus rate, the third air surplus rate is equal to or more than the second air surplus rate, and the fourth air surplus rate is equal to or more than the third air surplus rate.

Also, the first to third temperature ranges may be a range of 800° C. to 900° C., and the fourth temperature range may be equal to or lower than each of the first to third temperature ranges, and a range of 750° C. to 850° C.

Also, it is desirable that a residence time of a combustion gas in the first combustion section is in a range of 1.5 to 2.5 seconds, a residence time of a combustion gas in the second combustion section is in a range of 0.5 to 1.5 seconds, a residence time of a combustion gas in the first combustion section is in a range of 0.1 to 1.0 second, and a residence time of a combustion gas in the first combustion section is in a range of 1.5 to 2.5 seconds.

In still another aspect of the present invention, a fluidized bed incinerator having a combustion furnace includes first to fourth combustion sections. The fuel is supplied to the first combustion section and a combustion exhaust gas is exhausted after the fourth combustion section. First to fourth airs are supplied to the first to fourth combustion sections in first to fourth air surplus rates, respectively. It is desirable that the residence time of gas corresponding to the fuel in the first combustion section is in a range of 1.5 to 2.5 seconds; a residence time of the gas in the second combustion section is in a range of 0.5 to 1.5 seconds; a residence time of the gas in the third combustion section is in a range of 0.1 to 1.0 seconds; and a residence time of the gas in the fourth combustion section is equal to or more than 1.5 to 2.5 seconds.

In yet still another aspect of the present invention, a fluidized bed incinerator having a combustion furnace includes first to fourth combustion sections. The fuel is supplied to the first combustion section as a fluidized bed section and a combustion exhaust gas is exhausted after the fourth combustion section. First to fourth airs are supplied from first to fourth air supply ports to the first to fourth combustion sections, respectively. It is desirable that the first air supply port is provided in a bottom of the combustion furnace, the second air supply port is provided in a range of 1500 to 2100 mm from the bottom; the third air supply port is provided in a range of 3100 3700 mm from the bottom; and the fourth air supply port is provided in a range of 4100 to 4700 mm from the bottom.

In this case, it is desirable that the combustion furnace further may include a fuel input port provided in a range of 2100 to 2700 mm from the bottom.

DESCRIPTION OF THE PREFERRED EMBODIMENTS

Hereinafter, a fluidized bed incinerator of the present invention will be described in detail with reference to the attached drawings. The present invention will be described using the fluidized bed incinerator used for a boiler, for example, but the present invention can be applies to an apparatus using another fluidized bed combustion.

Figure 1:
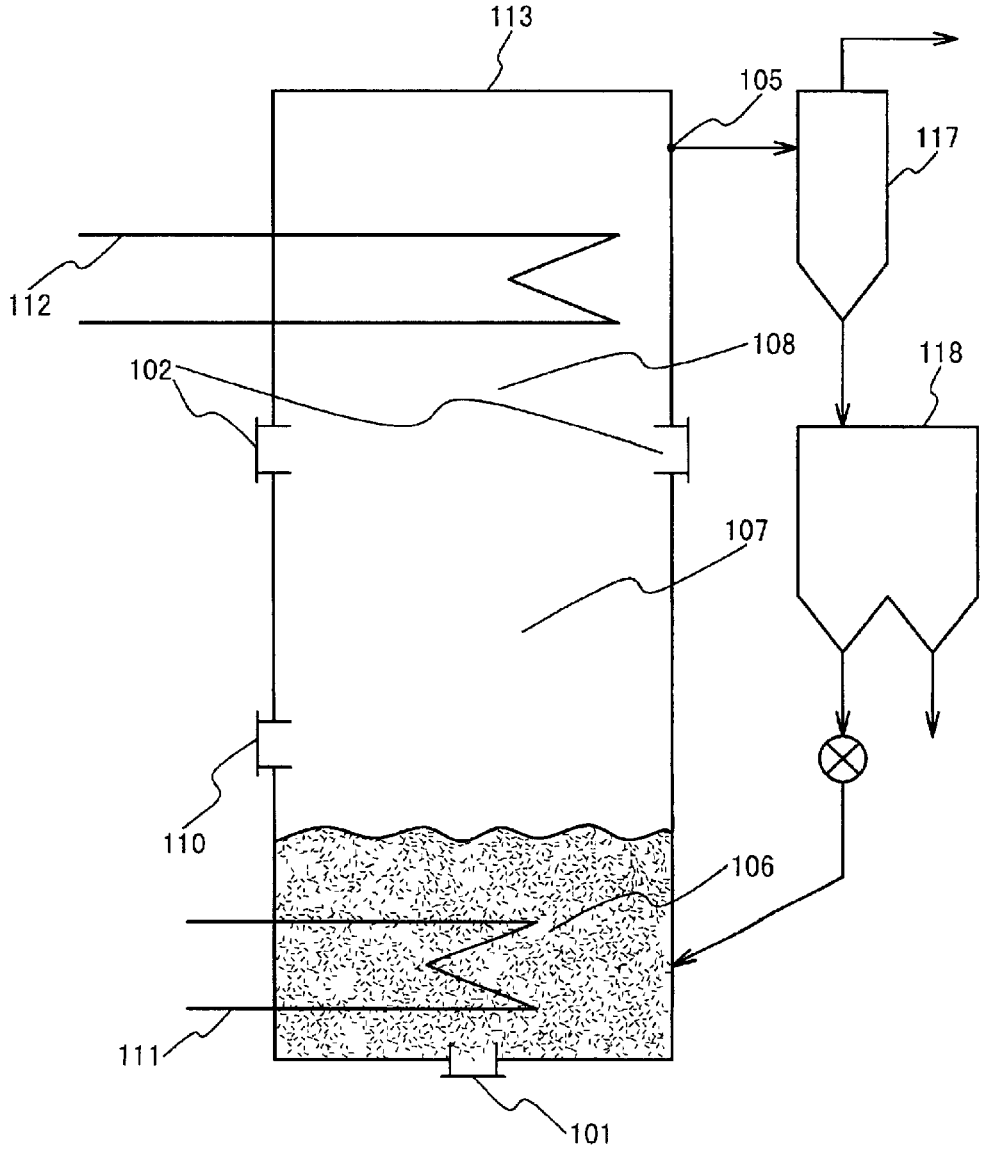
Fig. 1 PRIOR ART
FIG. 1 is a diagram showing a conventional fluidized bed incinerator.
Figure 2:
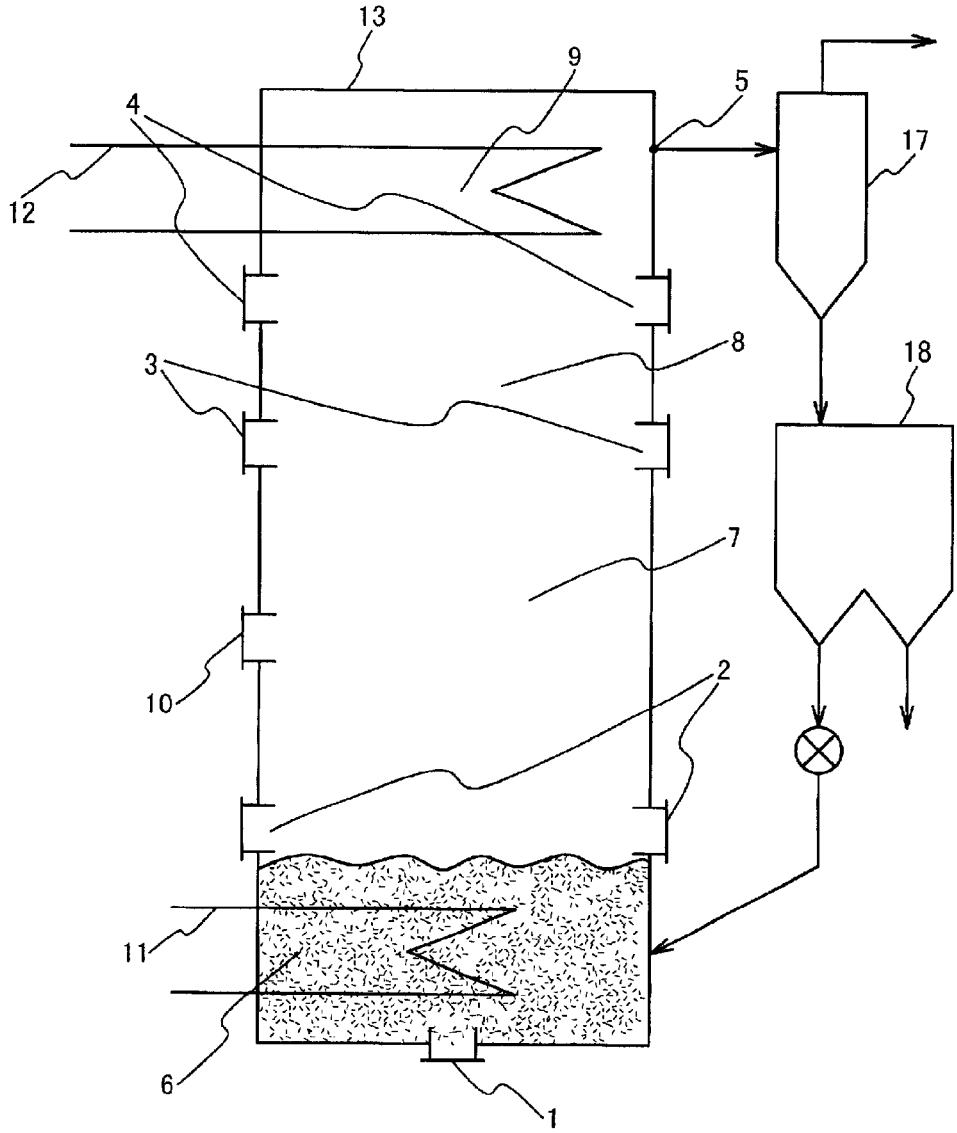
FIG. 2 is a diagram showing the structure of a fluidized bed incinerator according to a first embodiment of the present invention.

The fluidized bed incinerator according to the first embodiment of the present invention will be described. Referring to FIG. 2, in the fluidized bed incinerator according to the first embodiment of the present invention, the generation of $NO_x$, CO, and dioxine is suppressed at the same time by supplying the first air to the fourth airs into the incinerator from optimal positions. That is, oxidation of $NH_3$ and HCN into $NO_x$ (generation of fuel $NO_x$) is restrained by setting the atmosphere of a fluidized bed section 6 to deoxidation atmosphere. Also, the generation of thermal $NO_x$ is suppressed by restraining the rapid rising of temperature. In a free board sections, by securing a long residence time of combustion gas in the temperature range of 800 to 900° C. through the optimal supply of the second air to the fourth air, the combustion of CO and the dissolution of dioxine are promoted without the generation of thermal $NO_x$ at high temperature. In this way, the reduction of CO and dioxine is realized.

The fluidized bed incinerator according to the first embodiment of the present invention will be described in detail.

FIG. 2 is a diagram showing the structure of the fluidized bed incinerator in the first embodiment. The fluidized bed incinerator is composed of a combustion furnace A 13, a cyclone 17, and a hopper 18. The combustion furnace A 13 has a first air supply port 1, a second air supply port 2, a third air supply port 3, a fourth air supply port 4, a furnace output port 5, a fuel input port 10, a heat transferring section 11, and a convectional heat transferring section 12.

The first air supply port 1 is provided in the bottom of the combustion furnace A 13 and supplies air for the fluidized bed. The second air supply port 2, the third air supply port 3, and the fourth air supply port 4 are formed on the side section of the combustion furnace A 13 in this order in an upper direction to supply air for the combustion. The fuel input port 10 is used for supply of fuel, and is formed on the side section of the combustion furnace A 13 between the second air supply port 2 and the third air supply port 3. The heat transferring section 11 is a pipe which is provided between the first air supply port 1 and the second air supply port 2, and enters the inside of the combustion furnace A 13 from the side section of the furnace and exits from the side section of the combustion furnace A 13. The heat transferring section 11 controls the temperature of the fluidized bed. The convectional heat transferring section 12 is a pipe which is provided above the fourth air supply port 4, and enters the inside of the combustion furnace A 13 from the side section of the furnace and exits from the side section of the combustion furnace A 13. The convectional heat transferring section 12 collects heat of the combustion exhaust gas. The furnace output port 5 is provided in the top portion of the combustion furnace A 13 and an exit port of the combustion exhaust gas. The cyclone 17 is connected with the furnace output port 5 to collect non-combusted ash in the exhaust gas. The hopper 18 is provided below the cyclone 17 to store the non-combusted ash. A pipe connection is provided to supply the stored non-combusted ash to a lower portion of the combustion furnace A 13 again as fuel. The details will be described below.

The first air supply port 1 is located in the lowest portion of the combustion furnace A 13 and is a port from which air is supplied as oxidizing gas required for the combustion of the fuel. The supplied air rises, stirs and fluidizes the fuel and fluidized sand supplied from the fuel input port 10 and causes combustion reaction of the fuel. The incinerator has such a structure that in the supply of the air, the air introduced into the furnace A 13 is dispersed widely uniformly on a furnace base. Also, for the purpose, the first air supply port 1 may have a plurality of supply openings over the whole furnace base so that air can be released over the base surface in a uniform quantity.

The second air supply port 2 is a port which is located above a bed section (to be described later) and supplies the air required for the combustion of the fuel. The supplied air disperses the fuel and the fluidized sand which are supplied from the fuel input port 10 and causes combustion reaction with the fuel. The height of the second air supply port 2 from the bottom of the combustion furnace A 13 is in a range of 1500 to 2100 mm.

The third air supply port 3 is a port which is located above the fuel input port 10 and supplies the air required for the combustion of the fuel. The height of the third air supply port 3 from the bottom of the combustion furnace A 13 is in a range of 3100 to 3700 mm.

The fourth air supply port 4 is a port which is located above the third air supply port 3 and supplies the air required for the combustion of the fuel. The height of the fourth air supply port 4 from the bottom of the combustion furnace A 13 is in a range of 4100 to 4700 mm.

The furnace output port 5 is located in the top section of the combustion furnace A 13 and is an exit port from the combustion gas furnace.

The fuel input port 10 is a port which supplies the fuel required for the combustion in the combustion furnace. The fuel includes coal, petroleum coke, oil shell, wasted oil, wasted tire, paper sludge and so on. In this example, a mixture of the coal and the paper sludge is used as the fuel. The fluidized material includes particles such as silica and limestone. In this example, silica is used. The height of fuel the input port 10 from the bottom of the combustion furnace A 13 is in a range of 2100 to 2700 mm.

The heat transferring section 11 controls the temperature of the bed section 6 by flowing water or steam.

The convectional heat transferring section 12 is a portion which collects generated heat by heating medium circulating the inside. In this example, water or steam is used.

The bed section 6 is a region from the first air supply port 1 to a portion slightly below the second supply port 2. The bed section 6 is a fluidized bed in which the solid or liquid fuel and the fluidized sand supplied from the fuel input port 10 are risen, stirred and flowed by the air supplied from the first air supply port 1. Thus, the fuel and air are mixed and combusted.

A region above the bed section 6 in the furnace is called a free board section, and the fuel not combusted in the bed section 6 is combusted therein. The free board section is divided into three sections. The free board section A 7 is a region from the top of the bed section 6 to the third air supply port 3. Mainly, the fuel which has not been combusted in the bed section 6 and a gasified component of the fuel are combusted. The free board section B 8 is a region from the third air supply port 3 to the fourth air supply port 4. Mainly, the fuel which has not been combusted in the free board section A 7 and the gasified component of the fuel are combusted. The free board section C 9 is a region from the fourth air supply port 4 to the furnace output port 5. Mainly, the fuel which has not been combusted in the free board section B 8 and the gasified component of the fuel are combusted.

It should be noted that the cyclone 17 and the hopper 18 collect and store non-combusted ash in the exhaust gas. Then, a part of the stored non-combusted ash is returned to the fluidized bed. Thus, the consumption efficiency of the fuel can be increased.

Next, the operation of the fluidized bed incinerator of the present invention will be described in detail.

Referring to FIG. 2, first, air is supplied from the first air supply port 1 to the bottom of the combustion furnace A 13, and fluidized sand is introduced from the fuel input port 10. After the confirmation of fluidization of the fluidized sand, a mixture of fuel and fluidized sand is introduced from the fuel input port 10 to form a fluidized bed or bed section 6 and then combustion is started. The first air is supplied under the control by a control unit (not shown) such that an air surplus rate is in a range of 0.5 to 0.7 in the bed section 6. The air surplus rate is a rate of an air supply quantity to a theoretical air quantity. The temperature of the bed section 6 is controlled by adjusting a flow rate or temperature of water or steam flowing in the heat transferring section 11. The temperature is controlled in a range of 800 to 900° C. It should be noted that the temperature control may be achieved through the control of the air supply quantity and the air supply speed. At this time, the residence time of fuel, a dissolved gas of the fuel and the air in the bed section 6 is a range of 1.5 to 2.5 seconds.

In this way, by keeping the deoxidation atmosphere and the temperature equal to or less than 900° C., the generation of the fuel $NO_x$ through the oxidation reaction of $NH_3$ and HCN to $NO_x$ is suppressed. Also, rapid increase of the temperature is restrained to suppress generation of thermal $NO_x$. Oppositely, the dissolution of $NO_x$, $NH_3$, and HCN can be promoted through deoxidation reaction in the deoxidation atmosphere. Also, because the temperature is equal to or more than 800° C., the generation of dioxine can be suppressed and the dissolution of dioxine is proceeded.

However, because the air quantity is lack, a non-combusted component containing the combustible gas such as CO generated when the fuel is dissolved is left.

The gas containing the non-combusted component reaches the free board section A 7 and is combusted using the second air. Here, the second air supplied from the second air supply port 2 is controlled such that the air surplus rate is in a range of 0.7 to 0.9 as the combustion condition of the non-combusted component. Also, the temperature of the free board section A 7 is controlled in the 800 to 900° C. The temperature can be controlled based on an air supply quantity and air supply speed, and a quantity of the non-combusted component supplied from the bed section 6. The quantity of the non-combusted component can be controlled based on the fuel supply quantity at the initial stage and the combustion condition in the bed section 6. In the residence time of the gas containing the non-combusted component in the free board section A 7 is in a range in 0.5 to 1.5 seconds.

If the air surplus rate is increased to be equal to or more than 1.0 for complete combustion of the non-combusted component, the oxidation atmosphere is formed rapidly so that rapid combustion reaction occurs. Therefore, there is a high possibility that a large amount of $NO_x$ generates through the rapid increase in the combustion temperature and the generation of a local hot region. For these reasons, the free board section A 7 concatenated with the bed section 6, in which the air surplus rate is in a range of 0.5 to 0.7, is located in a deoxidation atmosphere with the air surplus rate in a range of 0.7 to 0.9. The dissolution of $NO_x$, $NH_3$, and HCN can be more promoted by elongating the residence time of the gas in the deoxidation atmosphere, following the bed section 6. Also, because the temperature is kept equal to or more than 800° C., the dissolution of dioxine which cannot be dissolved in the bed section 6 is proceeded. However, because the air quantity is lack, the non-combusted component is left even in this region.

The gas containing the non-combusted component and rising from the free board section A 7 reaches the free board section B 8 and is combusted using the third air. The third air supplied from the third air supply port 3 is controlled such that the air surplus rate is in a range of 0.9 to 1.15 as the combustion reaction with the non-combusted component. Also, the temperature of the free board section B 8 is controlled in a range of 800 to 900° C. The temperature can be controlled in an air supply quantity and an air supply speed, a quantity of the non-combusted component supplied from the free board section A 7. The residence time of the gas containing the non-combusted component in the free board section B 8 is in a range 0.1 to 1.0 second.

Even if the air surplus rate is set to about 1 in this stage, the rapid combustion reaction does not occur, because the combustion of fuel has been advanced. Therefore, the rapid temperature increase and the local hot region do not occur and generation of $NO_x$ is little. Also, because the temperature is kept equal to or more than 800° C., the dissolution of dioxine which has not been dissolved in the free board section A 7 can be promoted. Moreover, CO gas which has been generated in the free board section A 7 is combusted to generate $CO_2$, because the air quantity is CO gas left in the free board section B 8 is changed into $CO_2$ gas through the oxidation reaction, and becomes extinct approximately, because the air quantity is increased.

The reason why the air is separately supplied as the third air and the fourth air is that the region equal to or more than 800° C. is made long to promote the combustion reaction of CO and the dissolution of dioxine. In the first embodiment, the air surplus rate is set to be equal to or less than 0.9 in either of the first air and second air to suppress the generation of $NO_x$ greatly. For this reason, the non-combusted component containing CO is not yet little in a last portion of the free board section A 7. In such a situation, if an air supply port is limited to only the third air supply port 3, the air needs to be supplied in a very high air surplus rate which exceeds the air surplus rate of "1" for the complete combustion of the non-combusted fuel. In this case, the rapid combustion reaction occurs so that the rapid temperature increase occurs and the local hot region is generated. As a result, CO gas decreases but there is a high possibility that it is not possible to suppress the generation of $NO_x$. For these reasons, the air is supplied as the third air and the fourth air, and it is considered that the air surplus rate is increased.

The gas containing the non-combusted component and rising from the free board section B 8 reaches the free board section C 9 and is combusted using the fourth air. The fourth air supplied from the fourth air supply port 4 is controlled such that the air surplus rate is in a range of 1.15 to 1.6 for the combustion reaction with the non-combusted component. Also, the temperature of the free board section C 9 is controlled in a range of 750 to 850° C. The temperature can be controlled in an air supply quantity, an air supply speed, and a quantity of the non-combusted component supplied from the free board section B 8. The residence time of gas in the free board section C 9 is a range of 1.5 to 2.5 seconds.

The fourth air supply is the last air supply. Therefore, the fuel or gas must be combusted completely. For this reason, the air surplus rate is high. Even if the air surplus rate is set to be equal to or more than 1.1, the rapid combustion reaction does not occur, because the combustion of gas has been advanced to this step. Therefore, the rapid temperature increase and the local hot region do not occur and generation of $NO_x$ is little. Also, because the temperature is kept to about 800° C., the dissolution of dioxine which has not been dissolved in the free board section A 7 can be promoted. Moreover, equal to or more than one but is not a large value exceeding one greatly. In this way, it is possible to reduce CO gas while suppressing the generation of $NO_x$. Also, dioxine can be surely dissolved by making the region equal to or more than 800° C. long and taking a sufficiently long residence time of the exhaust gas. Moreover, it is necessary to flexibly measure the change of a quantity of dioxine to be processed, because a quantity of contained chlorine changes depending on the fuel to be used. Therefore, the fourth air supply port 4 is provided to extend the combustion region in an upper direction so that the dissolution process becomes sufficiently long to promote the dissolution process of dioxine even if the fuel contains a large amount of chlorine.

Figure 5:
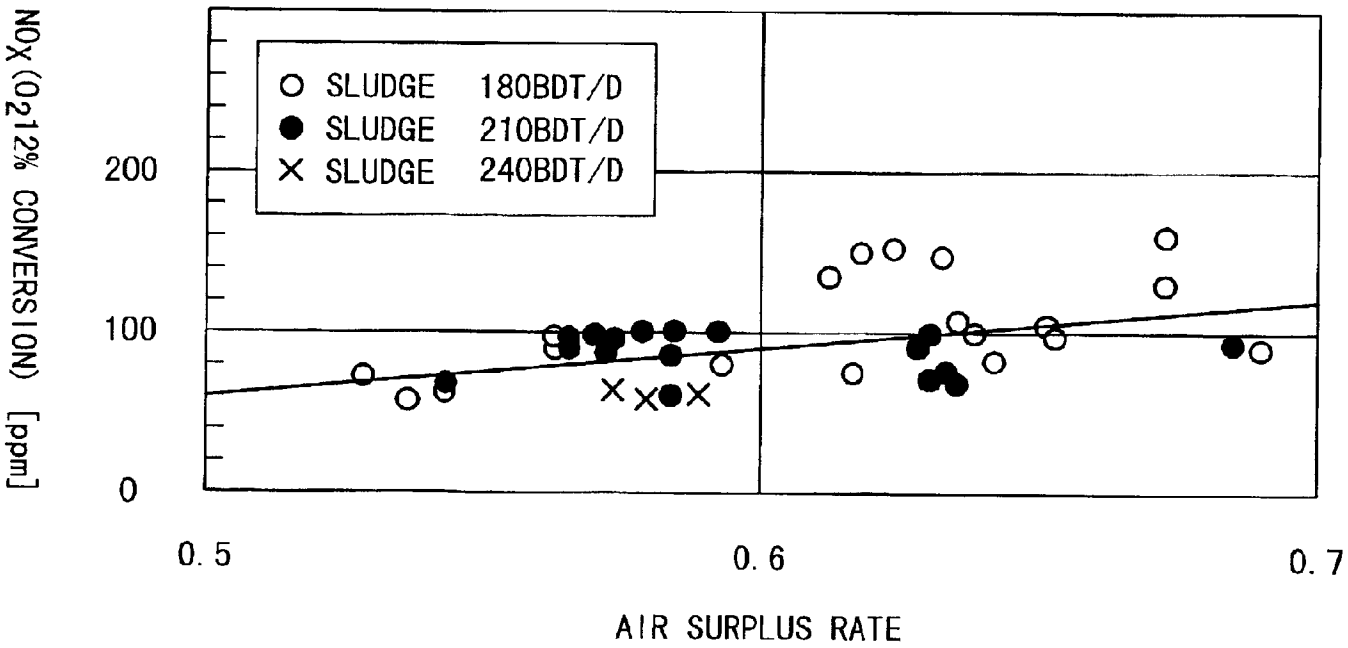
FIG. 5 is a graph showing relation between $NO_x$ and air surplus rate.

FIG. 5 shows a relation between the air surplus rate in the bed section 6 and the $NO_x$ quantity of the fluidized bed combustion boiler ($O_2$ 6% conversion). The vertical axis is $NO_x$ quantity (ppm) and the horizontal axis is the air surplus rate. The $NO_x$ quantity is suppressed when the air surplus rate is low in the bed section 6. It could be understood from FIG. 5 that the air surplus rate is preferably equal to or less than 0.7 in the bed section 6 to suppress $NO_x$.

Figure 6:
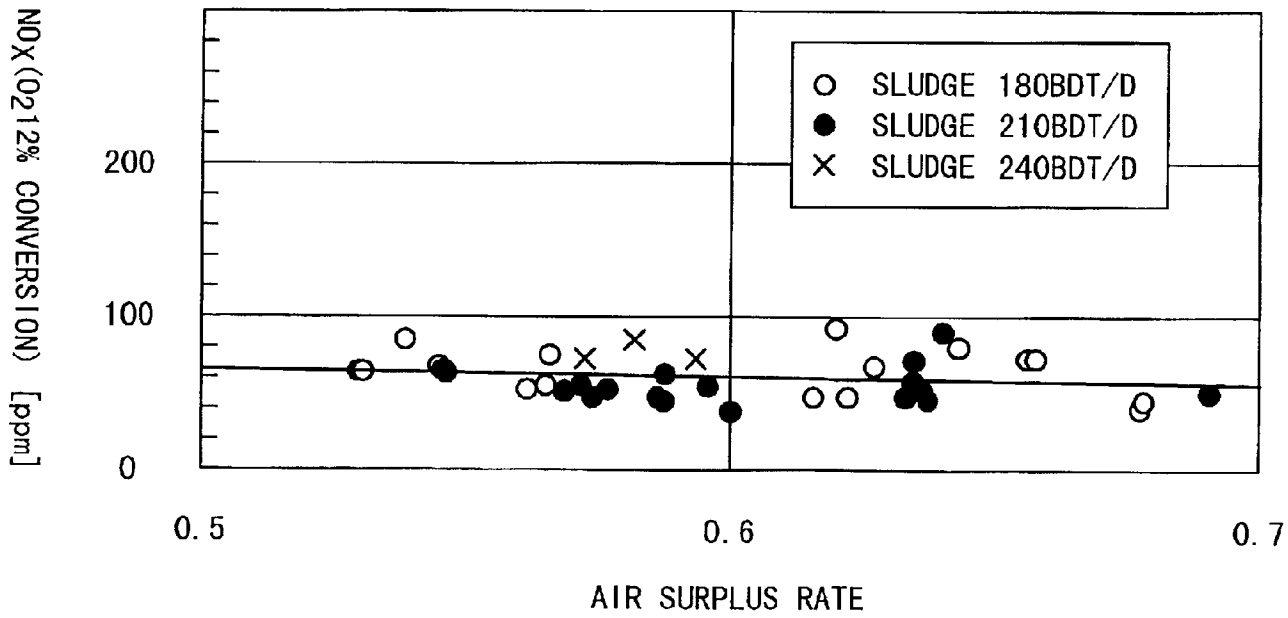
FIG. 6 is a graph showing relation between CO and air surplus rate.

Also, FIG. 6 shows a relation between the air surplus rate in the bed section 6 and the CO quantity of the fluidized bed combustion boiler (($O_2$ 12% conversion)). The vertical axis is CO quantity (ppm) and the horizontal axis is air surplus rate. The CO quantity is suppressed when the air surplus rate is high in the bed section 6. It could be understood from FIG. 6 that the air surplus rate is preferably equal to or more than 0.5 in the bed section 6 to suppress CO. Therefore, it could be understood from FIGS. 5 and 6 that the air surplus rate in the bed section 6 is preferably in a range of 0.5 to 0.7.

Also, when a combustion temperature in the bed section 6 is set to the equal to or less than 800° C., it is confirmed through an experiment that a quantity of generated dioxine increases depending on the decrease in the combustion temperature in the bed section 6.

The fluidized bed combustion is tested to realize the reduction of $NO_x$, CO, and dioxine in the above-mentioned combustion furnace based on the test result of the setting of the air surplus rate in the above bed section 6. Typical condition and result are shown below. First, the temperature, the air surplus rate, and the gas residence time are as follows. That is, in the measurement points in the regions (6–9), the temperature is 804° C., the air surplus rate is 0.82, and the residence time is 1.93 seconds in the bed section 6; the temperature is 838° C., the air surplus rate is 0.58, and the residence time is 1.04 seconds in the free board section A 7; the temperature is 872° C., the air surplus rate is 1.02, and the residence time is 0.55 seconds in the free board section B 8; and the temperature is 817° C., the air surplus rate is 1.30, and the residence time is 2.15 seconds in the free board section C8.

The first air supply port 1 is provided in the bottom of the combustion furnace. The second air supply port 2 is provided in the height of 800 mm from the bottom of the combustion furnace, the third air supply port 3 is provided in the height of 3400 mm from the bottom of the combustion furnace, and the fourth air supply port 4 is provided in the height of 4400 mm from the bottom of the combustion furnace. The fuel input port 10 is provided in the height of 2410 mm from the bottom of the combustion furnace. Under these conditions, the following results are obtained as the performance of the combustion furnace: $NO_x$ is 94 ppm ($O_2$ 6% conversion), CO is 46 ppm ($O_2$ 12% conversion), and dioxine is 0.1 ngTEQ/$Nm^3$ or below ($O_2$ 12% conversion). That is, in the present invention, the simultaneous reduction of $NO_x$, CO, and dioxine becomes possible without adding a post-processing unit to the combustion furnace.

It should be noted that in this example, the air is supplied from the four positions of different heights, containing the first air supply port 1 in the bottom. However, the similar effect can be achieved by supplying the air from the five or more positions of different heights.

Also, the combustion temperature is restrained to be equal to or less than 900° C. Therefore, the combustion furnace of the present invention can be realized without narrowing the width of the choice of the material of the furnace.

Figure 3:
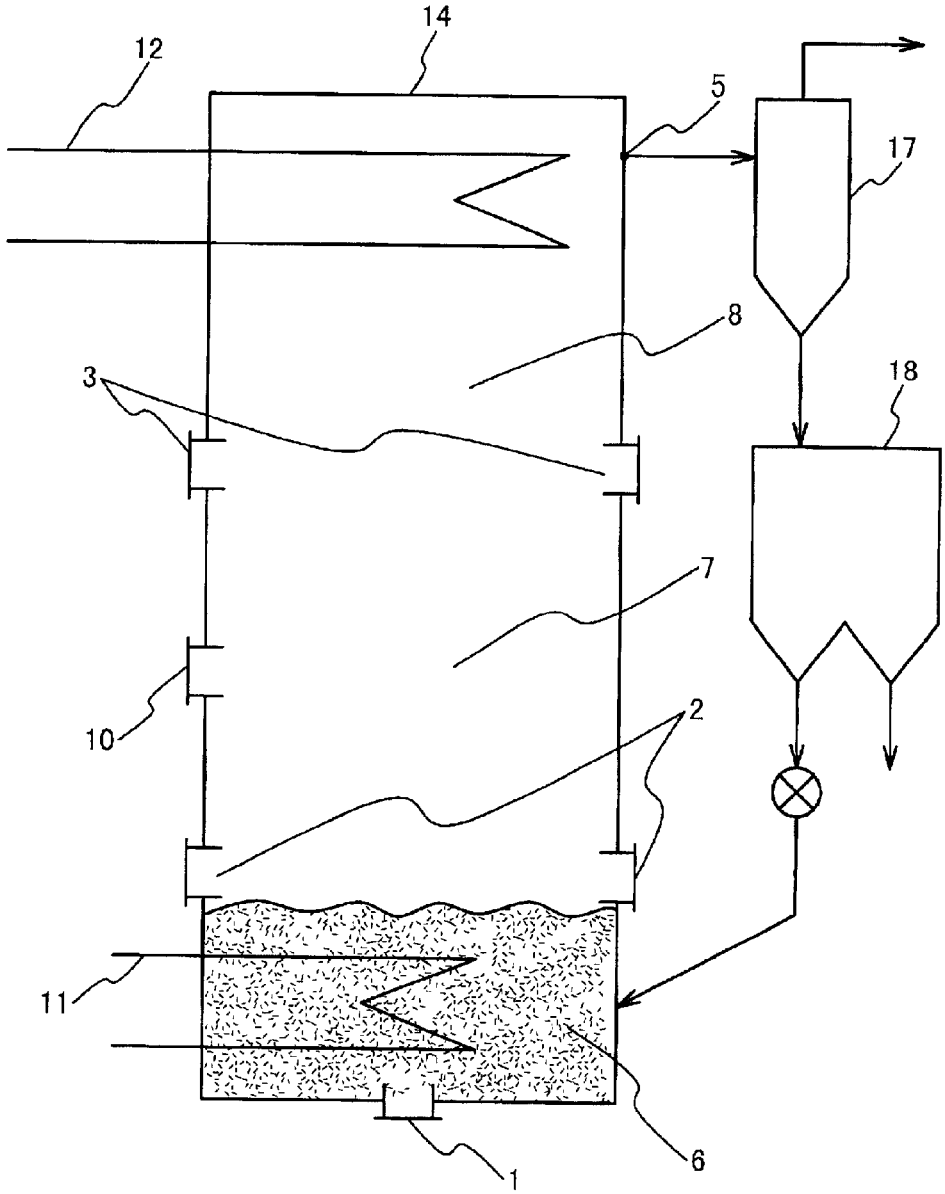
FIG. 3 is a diagram showing the structure of the fluidized bed incinerator according to a second embodiment of the present invention.

Next, the fluidized bed incinerator according to the second embodiment of the present invention will be described. Referring to FIG. 3, in the fluidized bed incinerator according to the second embodiment of the present invention, the second air supply port 2 is installed in the lower position to the extent not to influence a splash region on the top phase boundary of the bed section 6. Also, the suppression of generation of $NO_x$ is realized by making the region from the second air supply port 2 to the third air supply port 3 long to elongate the combustion region in the deoxidation atmosphere (at this time, it does not always need the fourth air). That is, the bed section 6 as the fluidized bed is set to the deoxidation atmosphere to restrains the oxidation reaction of $NH_3$ and HCN to $NO_x$ (generation of fuel NO). Also, rapid temperature increase is restrained to suppress the generation of thermal $NO_x$. Then, the second air is optimally supplied in the free board section A 7 to secure a long residence time in the temperature region of 800 to 900° C. Thus, the dissolution of $NO_x$, $NH_3$ and HCN through the deoxidation reaction can be promoted without generation of thermal $NO_x$ which is generated at high temperature.

The fluidized bed incinerator used for the boiler according to the second embodiment of the present invention will be described in detail.

FIG. 3 is a diagram showing the structure of the fluidized bed incinerator in the second embodiment. The fluidized bed incinerator is composed of a combustion furnace B14, a cyclone 17, and a hopper 18. The combustion furnace B14 has a first air supply port 1, a second air supply port 2, a third air supply port 3, a fourth air supply port 4, a furnace output port 5, a fuel input port 10, a heat transferring section 11, and a convectional heat transferring section 12. The positions of these components are similar to those of the first embodiments. It should be noted that the fourth air supply port 4 may be omitted from the figure because it is not always necessary.

The second air supply port 2 is located in a position located slightly above the bed section 6 and below the fuel input port 10. The third air supply port 3 is located above the fuel input port 10. The distance between the second air supply port 2 and the third air supply port 3 is set large. In such a structure, the following two methods could be considered: the second air supply port 2 is lowered as much as possible without influence on the splash region of the top phase boundary of the bed section 6, and the third air supply port 3 is risen as much as possible in addition to the first method. In the second embodiment, the method is adopted in which the second air supply port 2 is lowered as much as possible without influence on the splash region of the top phase boundary of the bed section 6. With the heights from the bottom of the combustion furnace B14, the height of the second air supply port 2 is 1200 mm, the height of the third air supply port 3 is 3700 mm, and the fuel supply port 10 is 1900 mm. Therefore, the distance between the second air supply port 2 and the third air supply port 3 becomes very as long as 2500 mm.

The function of each component of the combustion furnace B14 is same as that of the first embodiment except that the fourth air supply port 4 is omitted. Therefore, the description about each component is omitted.

Next, the operation of the fluidized bed incinerator in the second embodiment will be described. Referring to FIG. 3, first, air is supplied from the first air supply port 1 to the bottom of the combustion furnace B14 and fluidized sand is introduced from the fuel input port 10. After the confirmation of fluidization of the fluidized sand, a mixture of fuel and fluidized sand is introduced from the fuel input port 10 to form a fluidized bed (the bed section 6) and then combustion is started. The first air is supplied under the control by a control unit (not shown) such that an air surplus rate is in a range of 0.7 to 0.9 in the bed section 6. The reason why the air surplus rate is different from that of the first embodiment is that it is prevented that the bed section 6 is exposed to strong deoxidation atmosphere because there is not the fourth air supply port 4. The temperature of the bed section 6 is controlled by adjusting a flow rate or temperature of water or steam flowing in the heat transferring section 11. The temperature is controlled in a range of 800 to 900° C. It should be noted that the temperature control may be achieved through the control of the air supply quantity and the air supply speed.

In this way, by keeping the deoxidation atmosphere and the temperature equal to or less than 900° C., the generation of the fuel $NO_x$ through the oxidation reaction of $NH_3$ and HCN to $NO_x$ is suppressed. Also, rapid increase of the temperature is restrained to suppress generation of thermal $NO_x$. Oppositely, the dissolution of $NO_x$, $NH_3$, and HCN can be promoted through deoxidation reaction in the deoxidation atmosphere. Also, because the temperature is equal to or more than 800° C., the generation of dioxine can be suppressed and the dissolution of dioxine is proceeded.

Next, the gas the containing the non-combusted component and rising from the bed section 6 reaches the free board section A 7 and is combusted using the second air. The air surplus rate is in a range of 0.8 to 1.0 and the combustion temperature is in a range of 800 to 900° C. as the combustion condition. The reason why the air surplus rate is different from that of the first embodiment is that there is not the fourth air supply port 4 as mentioned above. The distance between the second air supply port 2 and the third air supply port 3 is set to as large as possible, so that the residence time of the fuel or reaction gas in this region can be made long. Therefore, the dissolution of NO, $NH_3$ and HCN through the deoxidation reaction can be promoted by placing the fuel or reaction gas in the deoxidation atmosphere for a long time, resulting in reduction of $NO_x$.

After that, the gas containing the non-combusted component and rising from the free board section A 7 reaches the free board section B 8 and is combusted using the third air. As the combustion condition, the air surplus rate is 1.0 or more and the temperature is in a range of 800 to 900° C. In this region, the non-combusted component is combusted and the combustion completes.

Figure 4:
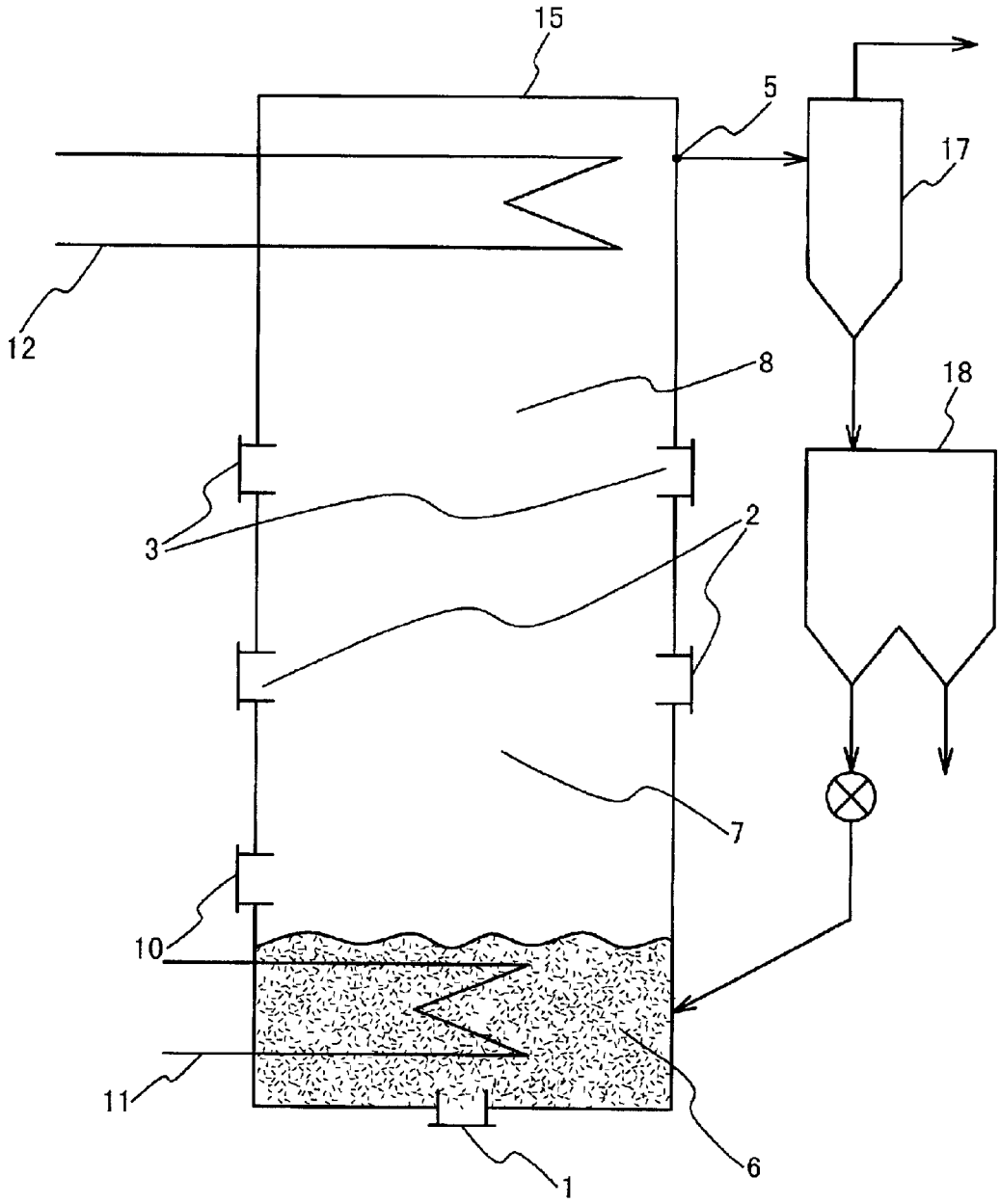
FIG. 4 is a diagram showing the structure of a fluidized bed incinerator for comparison.

Referring to FIG. 4, a comparison example is shown in which the second air supply port 2 is provided in a position above the fuel input port 10 which is provided above the bed section 6, unlike FIG. 3. In this case, with the height from the bottom of the combustion furnace C 15, the height is 2500 mm for the second air supply port 2, the height is 3700 mm for the third air supply port 3, and the height is 1200 mm for the fuel supply port 10. The distance from the second air supply port 2 to the third air supply port 3 is 1200 mm, and the distance in the combustion furnace B14 of the second embodiment (FIG. 3) is 2500 mm which is twice or more of the above distance. Therefore, the residence time is also expected to twice or more. As a result, there would be an effect in the reduction of $NO_x$.

Also, in the second embodiment (FIG. 3), the distance between the second air supply port 2 and the third air supply port 3 is made long. Therefore, it contributes to the $NO_x$ reduction that the fuel supply port 10 is provided above the second air supply port 2, compared with the comparison example of FIG. 4. That is, the supplied fuel is dispersed by the second air and is introduced into the bed section 6 and the reaction in the bed section 6 is uniform and efficient. Therefore, an extraordinary hot region and an air rich region because of ununiformity of the fuel and the first air are not generated in the bed section 6, resulting in suppression of the generation of $NO_x$.

A test of fluidized bed combustion is carried out to realize $NO_x$ reduction in the above-mentioned combustion furnace. In this case, the fourth air is supplied. The typical condition and a result are shown below. First, with the temperature, the air surplus rate, and the gas residence time in the comparison furnace of FIG. 4 (the fourth air supply section 4 is not shown), the temperature is 804° C. the air surplus rate is 0.83, and the residence time is 2.1 seconds between the first air supply port 1 and the second air supply port 2; the temperature is 838° C., the air surplus rate is 0.88, and the residence time is 0.7 seconds between the second air supply port 2 and the third air supply port 3; the temperature is 872° C., the air surplus rate is 1.25, and the residence time is 0.4 seconds between the third air supply port 3 and the fourth air supply port 4; and the temperature is 817° C., the air surplus rate is 1.56, and the residence time is 0.7 seconds between the fourth air supply port 4 and the furnace output port 5. The first air supply port 1 is provided in the bottom of the combustion furnace. The second air supply port 2 is provided in the height of 2535 mm, the third air supply port 3 is provided in the height of 3710 mm, and the fourth air supply port 4 is provided in the height of 4510 mm. The fuel input port 10 is provided in the height of 1200 mm.

On the other hand, the furnace of the present invention shown in FIG. 3 (the fourth air supply section 4 is not shown) is basically the same as that of FIG. 4. However, the fuel input port 10 is provided in the height of 1850 mm and the second air supply port 2 is provided in the height of 1200 mm. As a result, the distance from the second air supply port 2 to the third air supply port 3 is long, compared with the case of FIG. 4. Therefore, the residence time from the first air supply port 1 is 1.0 second, and the residence time from the second air supply port 2 to the third air supply port 3 is 1.5 seconds, which are different from those of FIG. 4 greatly. Especially, the residence time from the second air supply port 2 to the third air supply port 3 is surely about twice as mentioned above. $NO_x$ ($O_2$ 6% conversion) decreases from 235 ppm in case of FIG. 4 to 160 ppm as the performance of the combustion furnace under these conditions, and large $NO_x$ reduction effect is confirmed.

According to the present invention, the generation of $NO_x$, CO, and dioxine kind can be suppressed at the same time in the fluidized bed incinerator.

Also, according to the present invention, the generation of NOx can be suppressed in the fluidized bed incinerator.

What is claimed is:

1. A combustion method in a fluidized bed incinerator comprising the steps of:

(a) supplying fuel to a first combustion section as a fluidized bed;

(b) combusting the fuel in a first temperature range by first air supplied to said first combustion section, while suppressing generation of $NO_x$ and dioxine;

(c) combusting a non-combusted component of the fuel in a second temperature range by second air supplied to a second combustion section, while suppressing the generation of $NO_x$ and dioxine and dissolving $NO_x$ and dioxine generated in said first combustion section;

(d) combusting a non-combusted component of the fuel in a third temperature range by third air supplied to a third combustion section, while suppressing the generation of $NO_x$ and dioxine and dissolving $NO_x$ and dioxine generated in said second combustion section; and (e) carrying out complete combustion of a non-combusted component of the fuel in a fourth temperature range by fourth air supplied to a fourth combustion section, while suppressing the generation of $NO_x$ and dioxine and dissolving $NO_x$ and dioxine generated in said third combustion section.

2. The combustion method according to claim 1, wherein said (b) and (c) steps are carried out in a deoxidation atmosphere.

3. The combustion method according to claim 1, wherein said (e) step is carried out in an oxidation atmosphere.

4. The combustion method according to claim 1, wherein said first to fourth airs are supplied to said first to fourth combustion sections in first to fourth air surplus rates, respectively, and said second air surplus rate is equal to or more than said first air surplus rate, said third air surplus rate is equal to or more than said second air surplus rate, and said fourth air surplus rate is equal to or more than said third air surplus rate.

5. The combustion method according to claim 1, said first to third temperature ranges are a range of 800° C. to 900° C.

6. The combustion method according to claim 1, wherein said fourth temperature range is equal to or lower than each of said first to third temperature ranges, and a range of 750° C. to 850° C.

7. The combustion method according to claim 1, wherein a residence time of a combustion gas in said first combustion section is in a range of 1.5 to 2.5 seconds, a residence time of a combustion gas in said second combustion section is in a range of 0.5 to 1.5 seconds, a residence time of a combustion gas in said third combustion section is in a range of 0.1 to 1.0 second, and a residence time of a combustion gas in said fourth combustion section is equal to or more than 1.5 to 2.5 seconds.

8. A fluidized bed incinerator having a combustion furnace comprising:

first to fourth combustion sections, and wherein a fuel is supplied to said first combustion section as a fluidized bed section and an combustion exhaust gas is exhausted after said fourth combustion section, first to fourth air are supplied from first to fourth air supply ports to said first to fourth combustion section, respectively, and said first air supply port is provided in a bottom of said combustion furnace, said second air supply port is provided in a range of 1500 to 2100 mm from the bottom;

said third air supply port is provided in a range of 3100 to 3700 mm from said bottom; and said fourth air supply port is provided in a range of 4100 to 4700 mm from said bottom.

9. The fluidized bed incinerator according to claim 8, wherein said combustion furnace further comprises a fuel input port provided in a range of 2100 to 2700 mm from the bottom.

10. A fluidized bed incinerator having a combustion furnace comprising:

a first combustion section as a fluidized bed section to which fuel is supplied and first air is supplied from a first air supply port provided in a bottom of said combustion furnace;

second combustion section to which second air is supplied from a second air supply port provided in a range of 1500 to 2100 mm from the bottom;

a third combustion section to which third air is supplied from a third air supply port;

a fourth combustion section to which fourth air is supplied from a fourth air supply port, and an combustion exhaust gas is exhausted after said fourth combustion section; and a fuel input port provided in a range of 2100 to 2700 mm from the bottom.

11. A fluidized bed incinerator having a combustion furnace comprising:

first to fourth combustion sections, and wherein a fuel is supplied to said first combustion section and an combustion exhaust gas is exhausted after said fourth combustion section, first to fourth airs are supplied to said first to fourth combustion sections in first to fourth air surplus rates, respectively, and a residence time of gas corresponding to the fuel in said first combustion section is in a range of 1.5 to 2.5 seconds;

a residence time of the gas in said second combustion section is in range of 0.5 to 1.5 seconds;

a residence time of the gas in said third combustion section is in a range of 0.1 to 1.0 seconds; and a residence time of the gas in said fourth combustion section is equal to or more than 1.5 to 2.5 seconds.

12. A fluidized bed incinerator having a combustion furnace, comprising:

first to fourth combustion sections, and wherein a fuel is supplied to said first combustion section and an combustion exhaust gas is exhausted after said fourth combustion section, first to fourth airs are supplied to said first to fourth combustion sections in first to fourth air surplus rates, respectively, and said second air surplus rate is equal to or more than said first air surplus rate, said third air surplus rate is equal to or more than said second air surplus rate, and said fourth air surplus rate is equal to or more than said third air surplus rate, wherein said first combustion section combusts the fuel in a first temperature range in a deoxidation atmosphere by said first air, to suppress generation of $NO_x$ and dioxine, said second combustion section combusts a non-combusted component of the fuel in a second temperature range in the deoxidation atmosphere by said second air, to suppress the generation of $NO_x$ and dioxine and to dissolve $NO_x$ and dioxine generated in said first combustion section, said third combustion section combusts a non-combusted component of the fuel in a third temperature range by said third air, to suppress the generation of $NO_x$ and dioxine and to dissolve $NO_x$ and dioxine generated in said second combustion section, and said fourth combustion section carries out complete combustion of a non-combusted component of the fuel in a fourth temperature range in oxidization atmosphere by said fourth air, to suppress the generation of $NO_x$ and dioxine and to dissolve $NO_x$ and dioxine generated in said third combustion section.

13. The fluidized bed incinerator according to claim 12, wherein said first to third temperature ranges are substantially the same.

14. The fluidized bed incinerator according to claim 12, wherein said first to third temperature ranges are a range of 800° C. to 900° C.

15. The fluidized bed incinerator according to claim 12, wherein said fourth temperature range is equal to or lower than each of said first to third temperature ranges.

16. The fluidized bed incinerator according to claim 12, wherein said fourth temperature range is a range of 750° C. to 850° C.

17. The fluidized bed incinerator according to claim 12, wherein said first temperature range of said first combustion section is controlled by a first temperature control section.

18. The fluidized bed incinerator according to claim 12, wherein said fourth temperature range of said fourth combustion section is controlled by a second temperature control section.

19. The fluidized bed incinerator according to claim 12, wherein said second and third temperature ranges of said second and third combustion sections are controlled by changing said second and third air surplus rates, respectively.

20. A fluidized bed incinerator having a combustion furnace comprising:

first to fourth combustion sections, and wherein a fuel is supplied to said first combustion section and an combustion exhaust gas is exhausted after said fourth combustion section, first to fourth airs are supplied to said first to fourth combustion sections in first to fourth air surplus rates, respectively, and said second air surplus rate is equal to or more than said first air surplus rate, said third air surplus rate is equal to or more than said second air surplus rate, and said fourth air surplus rate is equal to or more than said third air surplus rate, wherein said first combustion section is a fluidized bed combustion section, and has a first air supply port provided in a bottom of said first combustion section, wherein said second combustion has a second air supply port provided in a range of 1500 to 2100 mm from the bottom;

said third combustion section has a third air supply port provided in a range of 3100 to 3700 mm from said bottom; and said fourth combustion section has a fourth air supply port provided in a range of 4100 to 4700 mm from said bottom.

21. The fluidized bed incinerator according to claim 20, wherein said first air surplus rate is in a range of 0.5 to 0.7, said second air surplus rate is a range of 0.7 to 0.9, said third air surplus rate is in a range of 0.9 to 1.15, and said fourth air surplus rate is in a range of 1.15 to 1.6.

22. The fluid bed incinerator according to claim 20, wherein a residence time of a combustion gas in said first combustion section is in a range of 1.5 to 2.5 seconds, a residence time of a combustion gas in said second combustion section is in a range of 0.5 to 1.5 seconds, a residence time of a combustion gas in said third combustion section is in a range of 0.1 to 1.0 seconds, and a residence time of a combustion gas in said fourth combustion section is equal to or more than 1.5 to 2.5 seconds.

23. The fluidized bed incinerator according to claim 20, further comprising a fuel supply port provided between said second air supply port and said third air supply port.

* * * * *